US006484728B1

(12) United States Patent
Chang

(10) Patent No.: US 6,484,728 B1
(45) Date of Patent: Nov. 26, 2002

(54) HAIR CLIP WITH IMPROVED CLIPPING EFFECT

(76) Inventor: Wen-Hsiiung Chang, No. 7, Alley 116, Lane 175, Sec. 1, Tatung Rd., Tainan City (TW)

( * ) Notice: Subject to any disclaimer, the term of this patent is extended or adjusted under 35 U.S.C. 154(b) by 55 days.

(21) Appl. No.: 09/908,029

(22) Filed: Jul. 19, 2001

(51) Int. Cl.[7] ..... A45D 24/06; A45D 8/00; A45D 24/00

(52) U.S. Cl. ..... 132/133; 132/276; 132/160

(58) Field of Search ..... 132/133, 160, 132/138, 156, 148, 276

(56) References Cited

U.S. PATENT DOCUMENTS 717,499 A * 12/1902 Gouy ..... 132/133
794,828 A * 7/1905 Winn ..... 132/279
1,070,064 A * 8/1913 Parfrey ..... 132/160
1,721,837 A * 7/1929 Schurger ..... 132/133
1,929,849 A * 10/1933 Noto ..... 132/160
2,604,101 A * 7/1952 Helfgott ..... 132/160
2,718,894 A * 9/1955 Gresham et al. ..... 132/133
2,902,042 A * 9/1959 Halber ..... 132/133
3,998,233 A * 12/1976 Dorr ..... 132/133
5,655,550 A * 8/1997 Keating ..... 132/133
5,676,166 A * 10/1997 Chang ..... 132/279
5,775,343 A * 7/1998 Zarn ..... 132/210

* cited by examiner

*Primary Examiner*—John J. Wilson
*Assistant Examiner*—Robyn Kieu Doan
(74) *Attorney, Agent, or Firm*—Charles E. Baxley

(57) ABSTRACT

A hair clip comprises a first clip member including a first arcuate rod and a second clip member including a second arcuate rod. The second arcuate rod includes a first end pivotally engaged with a first end of the first arcuate rod and a second end releasably engaged with the second end of the first arcuate rod. Arcuate first teeth project from the first arcuate rod and extend toward the second arcuate rod. Arcuate second teeth project from the second arcuate rod and extend toward the first arcuate rod.

6 Claims, 6 Drawing Sheets

HAIR CLIP WITH IMPROVED CLIPPING EFFECT

BACKGROUND OF THE INVENTION

1. Field of the Invention

The present invention relates to a hair clip with improved clipping effect.

2. Description of the Related Art

FIG. 5 of the drawings illustrates a hair clip suit for men and women that includes a first clip member 1' and a second clip member 2'. A peg 12' with an engaging end 13' is formed on a first end of the first clip member 1' and is pivotally connected with a pivot hole 23' defined in two spaced lugs 22' on a first end of the second clip member 2'. Another peg 12' with an engaging end 13' is formed on a second end 12' of the first clip member 1' and is releasably engaged with a second end of the second clip member 2'. Each clip member 1', 2' has a plurality of straight teeth 14', 24' extending inwardly from an inner side thereof. Thus, the hair clip can be moved to an open state shown in FIG. 6 or a closed state shown in FIG. 7 for clipping hair. However, although the hair clip is engaged on the hair by the alternately disposed teeth 14' and 24', it was found that the hair clip cannot be securely retained on the hair. It is discomfort when wearing. The hair clip tends to disengage from the hair before it is moved to the open state.

SUMMARY OF THE INVENTION

It is the primary object of the present invention to provide a hair clip with improved clipping effect to prevent disengagement of the hair clip from the user's hair.

A hair clip in accordance with the present invention comprises a first clip member including a first arcuate rod and a second clip member including a second arcuate rod. The second arcuate rod includes a first end pivotally engaged with a first end of the first arcuate rod and a second end releasably engaged with the second end of the first arcuate rod. A plurality of arcuate first teeth projects from the first arcuate rod and extends toward the second arcuate rod. A plurality of arcuate second teeth projects from the second arcuate rod and extends toward the first arcuate rod.

In an embodiment of the invention, the first arcuate rod includes an outer side that faces away from the second arcuate rod. The arcuate first teeth project from the outer side of the first arcuate rod and extend toward the second arcuate rod. The second arcuate rod includes an outer side that faces away from the first arcuate rod. The arcuate second teeth project from the outer side of the second arcuate rod and extend toward the first arcuate rod.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
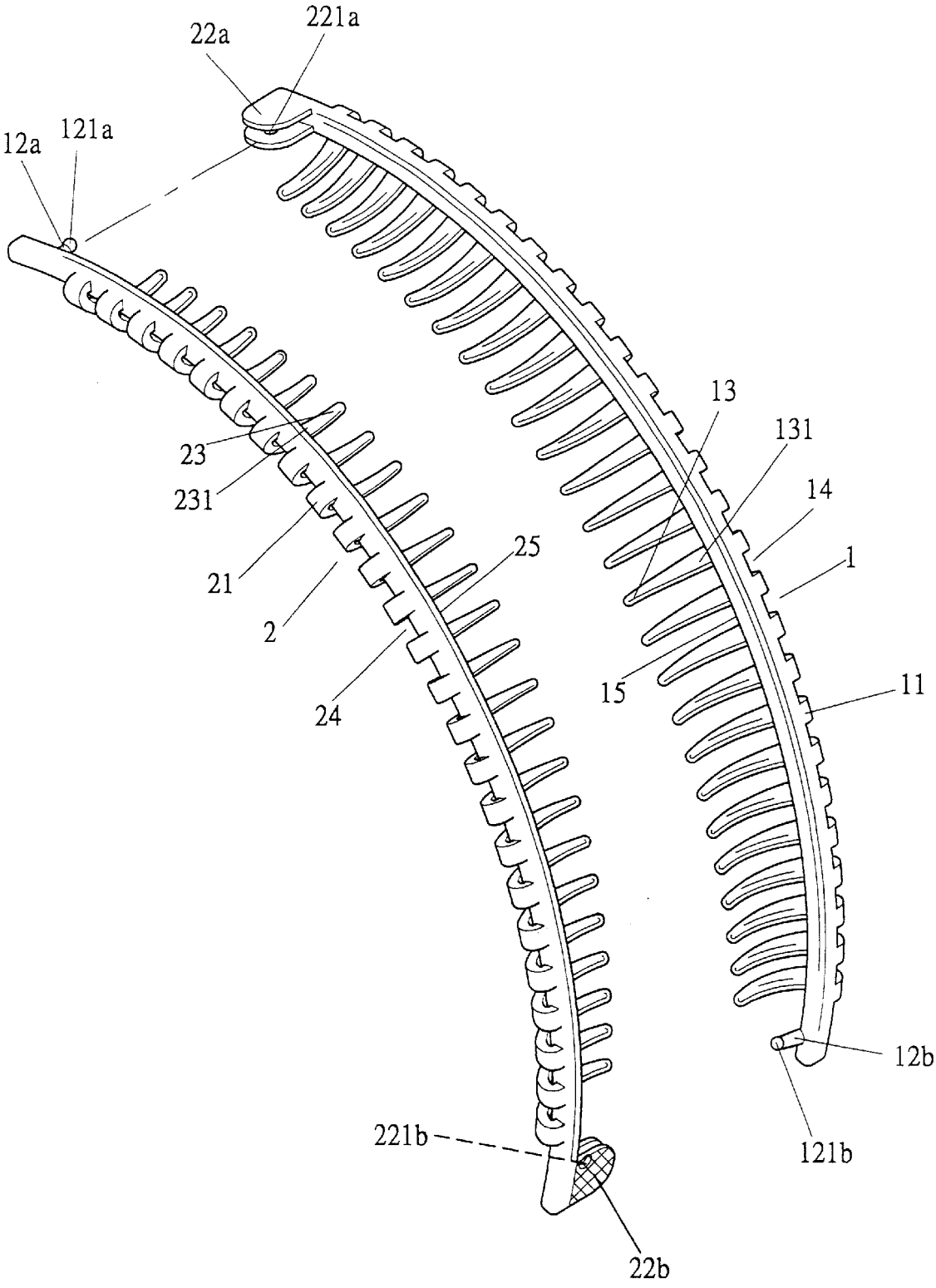
FIG. 1 is an exploded perspective view of a hair clip in accordance with the present invention.
Figure 2:
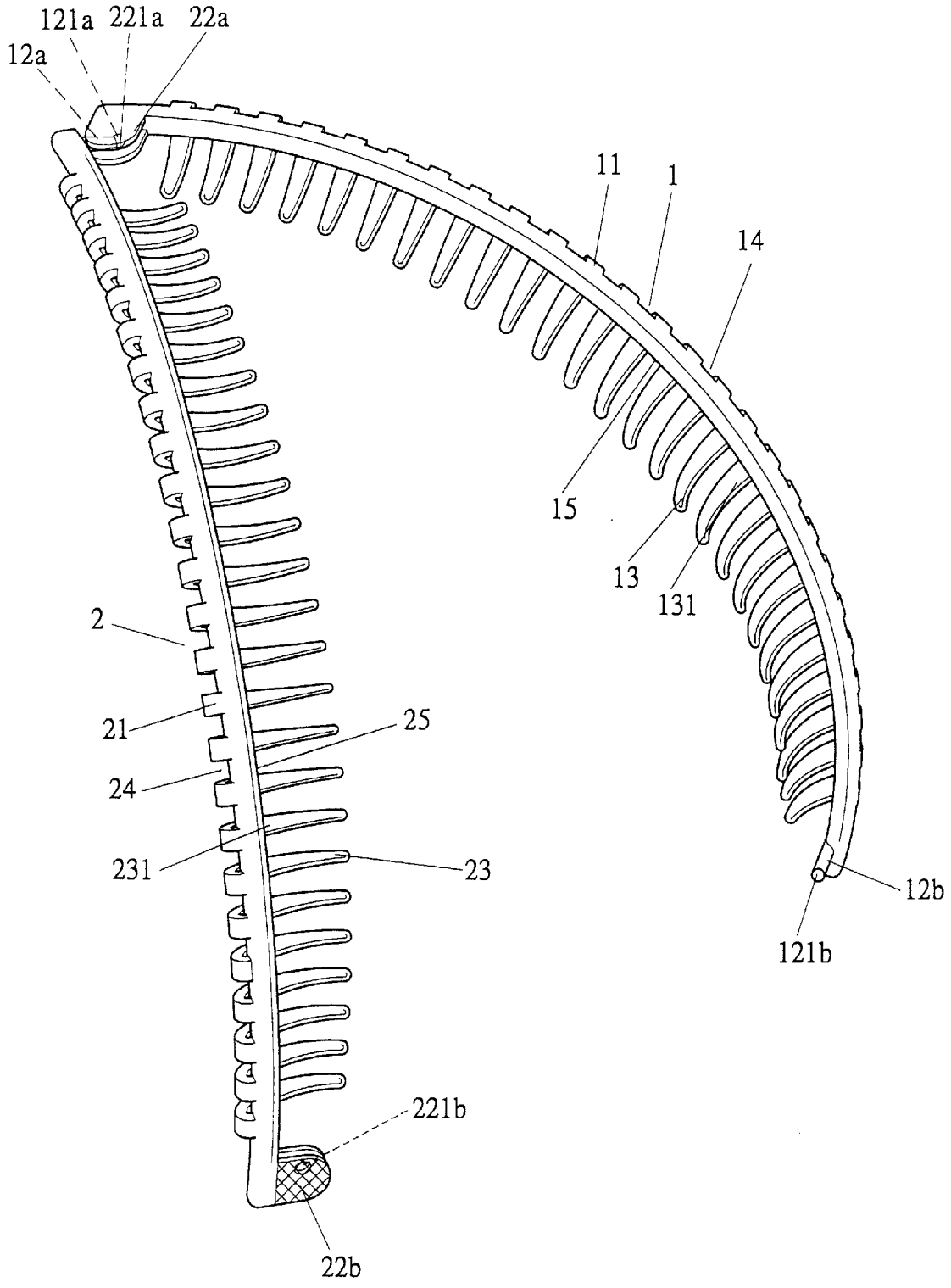
FIG. 2 is a perspective view of the hair clip in accordance with the present invention in an open state.
Figure 3:
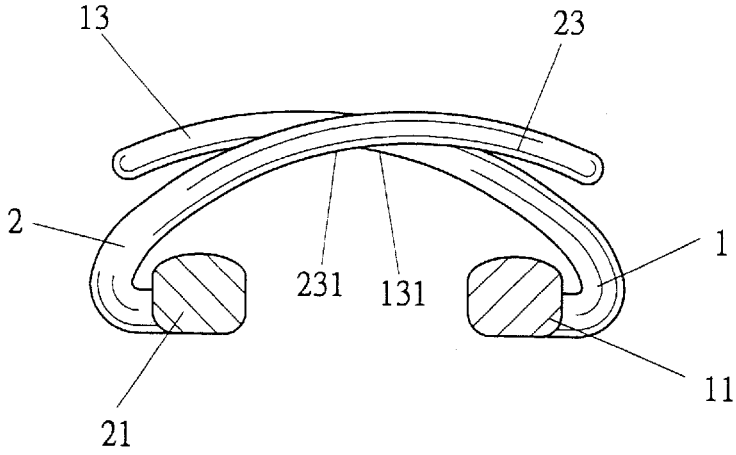
FIG. 3 is a sectional view of the hair clip in accordance with the present invention in a closed state.

Referring to FIGS. 1 through 4 and initially to FIGS. 1 and 2, a hair clip in accordance with the present invention generally includes a first clip member 1 and a second clip member 2. The first clip member 1 includes an arcuate rod 11 that is configured to conform to the contour of a user's head. Similarly, the second clip member 2 includes an arcuate rod 21 that is configured to the contour of the user's head.

The arcuate rod 11 has a first end pivotally connected with a second end of the arcuate rod 21. A second end of the arcuate rod 11 is releasably engaged with a second end of the arcuate rod 21. In this embodiment, a peg 12*a* with an engaging end 121*a* is formed on the first end of the arcuate rod 21 and a peg 12*b* with an engaging end 121*b* is formed on the second end of the arcuate rod 11. A pair of spaced lugs 22*a* is formed on the first end of the arcuate rod 11 and includes a pivot hole 221*a* for pivotally engaging with the engaging end 121*a* of the peg 12*a*. A pair of spaced lugs 22*b* is formed on the second end of the arcuate rod 21 and includes an engaging hole 221*b* for releasably engaging with the engaging end 121*b* of the peg 12*b*. Thus, the hair clip can be moved to an open state shown in FIG. 2 or a closed state (FIG. 4) for clipping hair.

Figure 4:
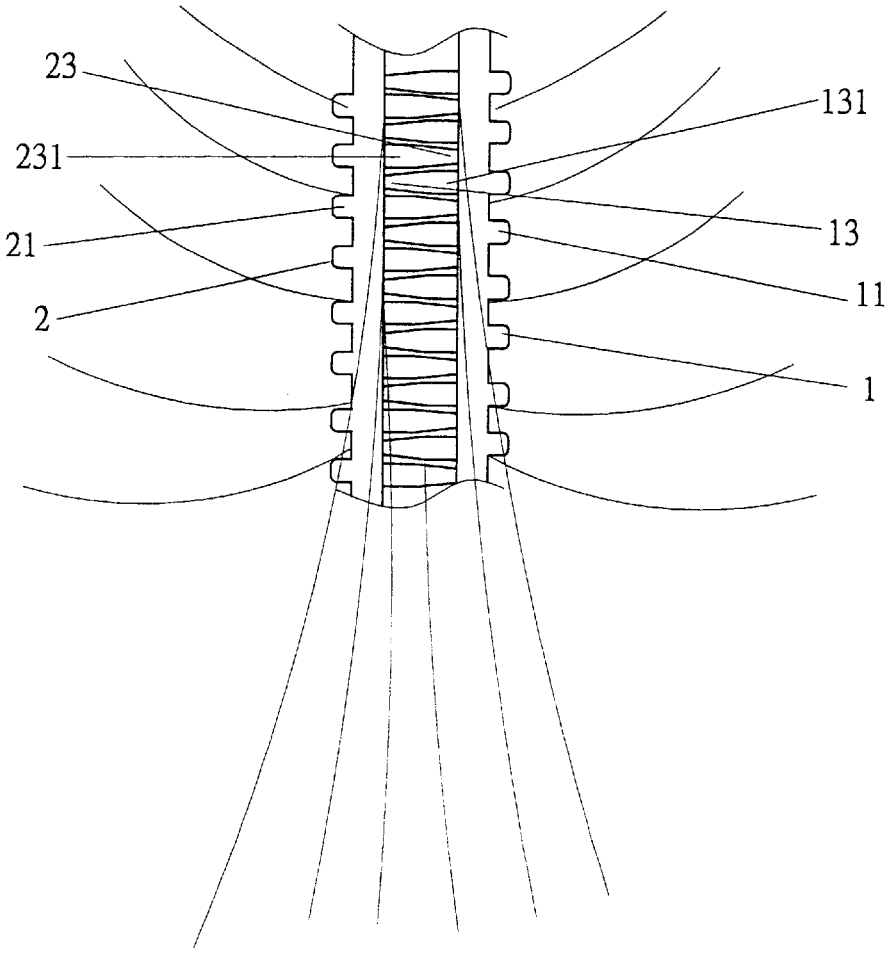
FIG. 4 is a partial schematic view illustrating use of the hair clip in accordance with the present invention.
Figure 5:
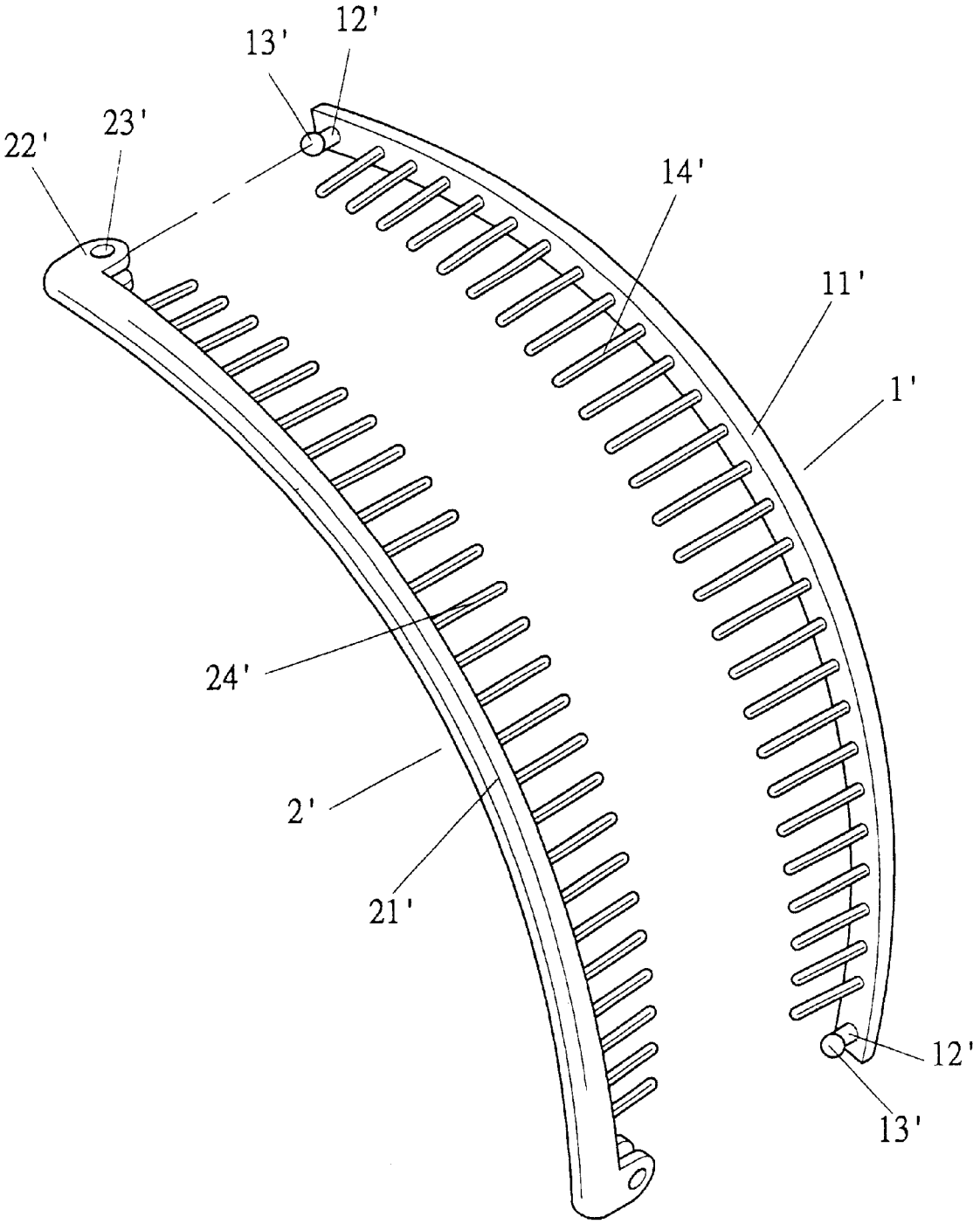
F I G . 5 (PRIOR ART)
FIG. 5 is an exploded perspective view of a conventional hair clip.
Figure 6:
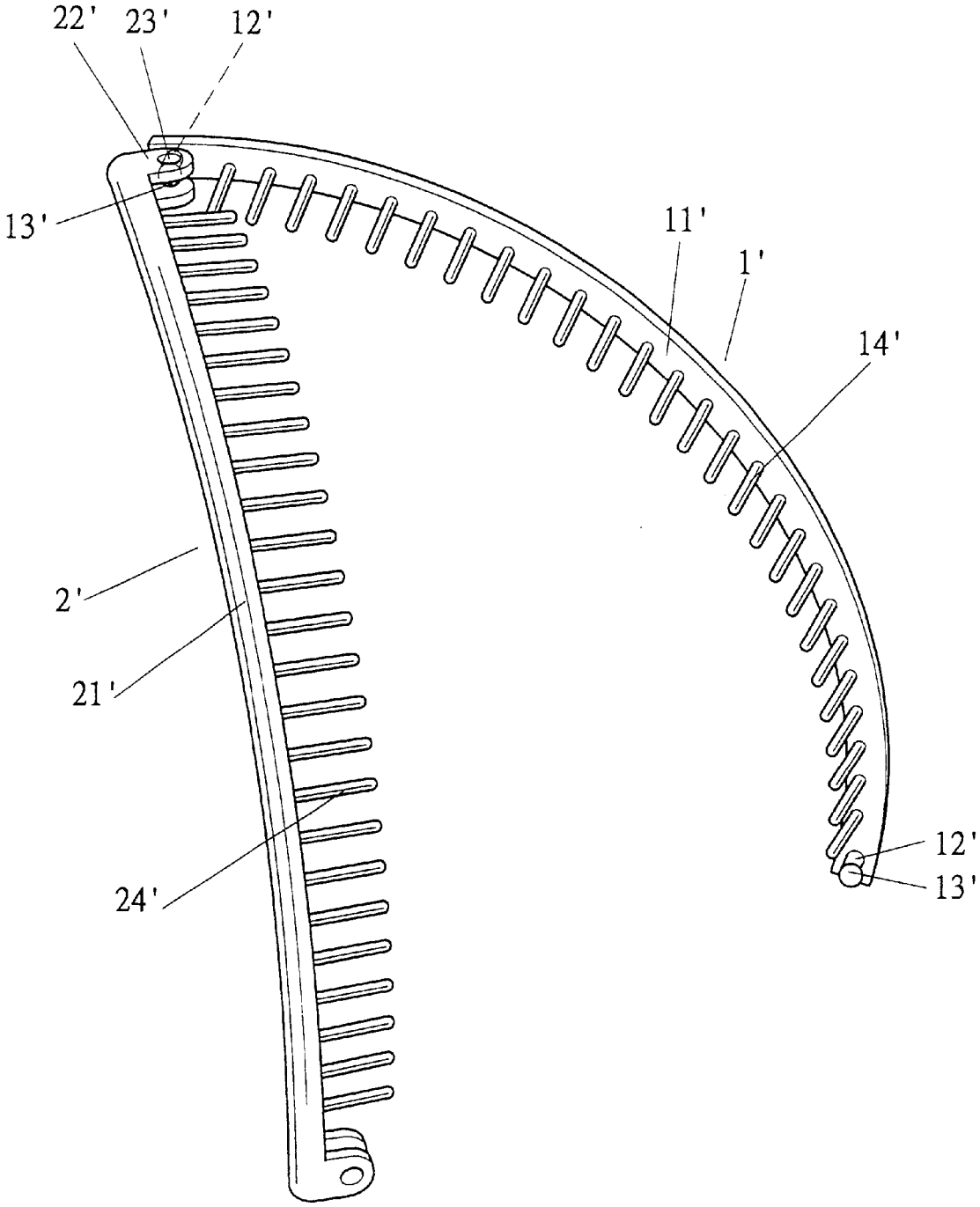
F I G . 6 (PRIOR ART)
FIG. 6 is a perspective view of the conventional hair clip.
Figure 7:
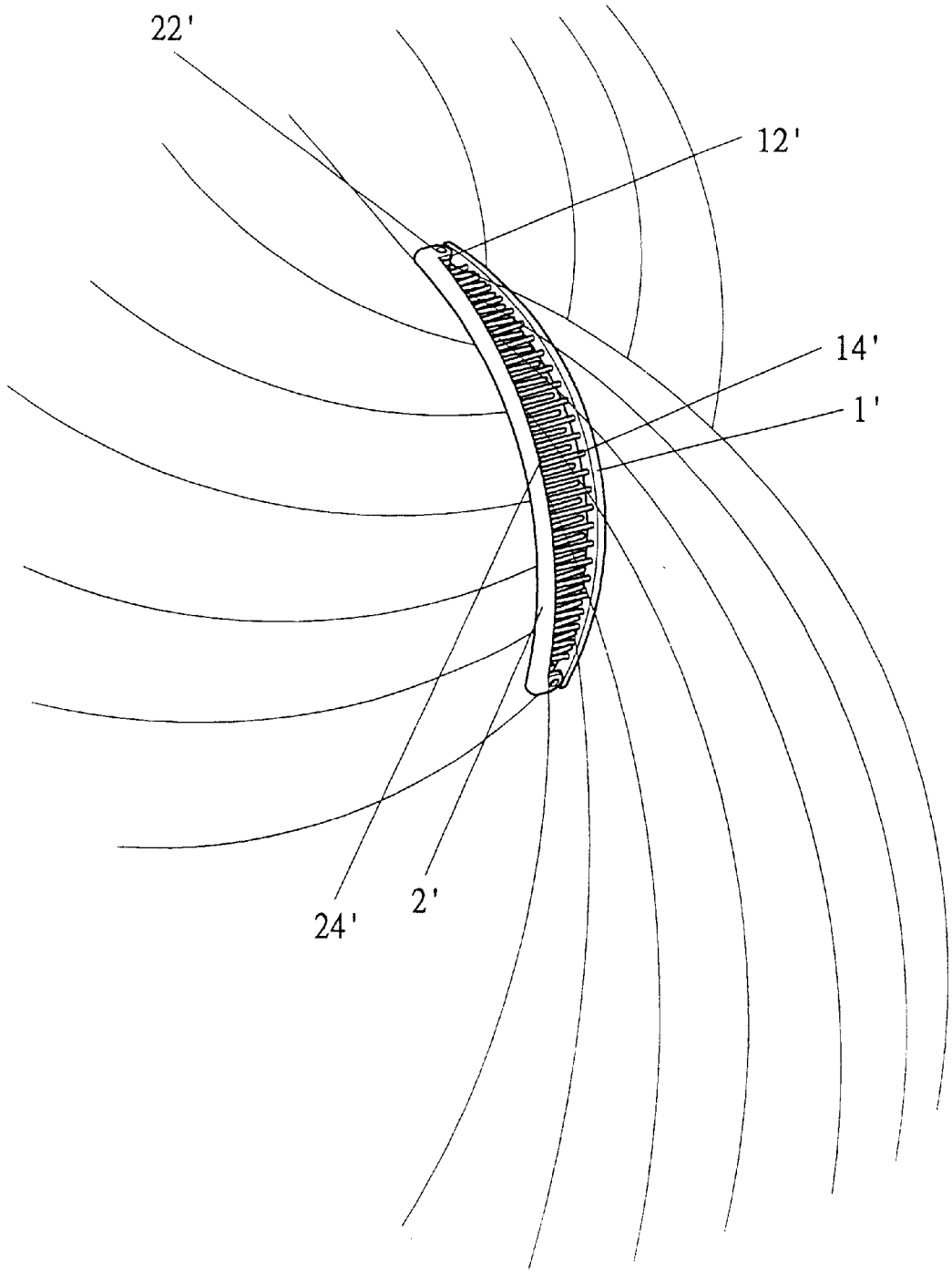
F I G . 7 (PRIOR ART)
FIG. 7 is a schematic perspective view illustrating use of the conventional hair clip.

The arcuate rod 11 further includes an inner side 15 that faces the second clip member 2 and an outer side 14 that faces away from the arcuate rod 21. The arcuate rod 21 further includes an inner side 25 that faces the first clip member 2 and an outer side 24 that faces away from the arcuate rod 11. A plurality of arcuate teeth 13 projects from the outer side 14 of the arcuate rod 11 and extends toward the arcuate rod 21. Similarly, a plurality of arcuate teeth 23 projects from the outer side 24 of the arcuate rod 21 and extends toward the arcuate rod 11, best shown in FIG. 3. It is noted that each tooth 13, 23 tapers toward its distal end. Namely, each tooth 13, 23 has a wider portion 131, 231 having a width greater than that of the conventional hair clip. When the hair clip is in its closed state, the arcuate teeth 13 and 23 are alternately disposed, as shown in FIG. 4. The wider portions 131 and 231 of the teeth 13 and 23 provide a better engagement with the user's hair and thus prevent disengagement of the hair clip from the user's hair.

Although the invention has been explained in relation to its preferred embodiment, it is to be understood that many other possible modifications and variations can be made without departing from the scope of the invention as hereinafter claimed.

What is claimed is:

1. A hair clip, comprising:

a) a first clip member;

b) a second clip member;

c) a plurality of arcuate first teeth; and d) a plurality of arcuate second teeth;

wherein said first clip member includes a first arcuate rod;

wherein said first arcuate rod of said first clip member has a first end;

wherein said first arcuate rod of said first clip member has a second end;

wherein said second clip member includes a second arcuate rod;

wherein said second arcuate rod of said second clip member has a first end;

wherein said second arcuate rod of said second clip member has a second end;

wherein said first end of said second arcuate rod is pivotally engaged with said first end of said first arcuate rod;

wherein said second end of said second arcuate rod is releasably engaged with said second end of said first arcuate rod;

wherein said first arcuate rod has an outer side;

wherein said outer side of said first arcuate rod faces away from said second arcuate rod;

wherein said plurality of arcuate first teeth project from said outer side of said first arcuate rod and extend toward said second arcuate rod;

wherein said second arcuate rod has an outer side;

wherein said outer side of said second arcuate rod faces away from said first arcuate rod; and wherein said plurality of arcuate second teeth project from said outer side of said second arcuate rod and extend toward said first arcuate rod.

2. The hair clip as defined in claim 1, wherein each tooth of said plurality of arcuate first teeth has a proximal end;

wherein said proximal end of each tooth of said plurality of arcuate first teeth is coincident with said outer side of said first arcuate rod;

wherein each tooth of said plurality of arcuate first teeth has a distal end;

wherein said distal end of each tooth of said plurality of arcuate first teeth is free; and wherein each tooth of said plurality of arcuate first teeth tapers from said proximal end thereof to said distal end thereof.

3. The hair clip as defined in claim 1, wherein each tooth of said plurality of arcuate second teeth has a proximal end;

wherein said proximal end of each tooth of said plurality of arcuate second teeth is coincident with said outer side of said second arcuate rod;

wherein each tooth of said plurality of arcuate second teeth has a distal end;

wherein said distal end of each tooth of said plurality of arcuate second teeth is free; and wherein each tooth of said plurality of arcuate second teeth tapers from said proximal end thereof to said distal end thereof.

4. A hair clip, comprising:

a) a first clip member;

b) a second clip member;

c) a plurality of arcuate first teeth; and d) a plurality of arcuate second teeth;

wherein said first clip member includes a first arcuate rod;

wherein said first arcuate rod of said first clip member has a first end;

wherein said first arcuate rod of said first clip member has a second end;

wherein said second clip member includes a second arcuate rod;

wherein said second arcuate rod of said second clip member has a first end;

wherein said second arcuate rod of said second clip member has a second end;

wherein said first end of said second arcuate rod is pivotally engaged with said first end of said first arcuate rod;

wherein said second end of said second arcuate rod is releasably engaged with said second end of said first arcuate rod;

wherein said first arcuate rod has an outer side;

wherein said outer side of said first arcuate rod faces away from said second arcuate rod;

wherein said plurality of arcuate first teeth project from said outer side of said first arcuate rod and extend toward said second arcuate rod;

wherein each tooth of said plurality of arcuate first teeth has a proximal end;

wherein each tooth of said plurality of arcuate first teeth has a distal end;

wherein said proximal end of each tooth of said plurality of arcuate first teeth is coincident with said outer side of said first arcuate rod;

wherein each tooth of said plurality of arcuate first teeth is entirely concave from said proximal end thereof to said distal end thereof relative to said first arcuate rod;

wherein said second arcuate rod has an outer side;

wherein said outer side of said second arcuate rod faces away from said first arcuate rod; and wherein said plurality of arcuate second teeth project from said outer side of said second arcuate rod and extend toward said first arcuate rod;

wherein each tooth of said plurality of arcuate second teeth has a proximal end;

wherein each tooth of said plurality of arcuate first second has a distal end;

wherein said proximal end of each tooth of said plurality of arcuate second teeth is coincident with said outer side of said second arcuate rod; and wherein each tooth of said plurality of arcuate second teeth is entirely concave from said proximal end thereof to said distal end thereof relative to said second arcuate rod.

5. The hair pin as defined in claim 4, wherein said distal end of each tooth of said plurality of arcuate first teeth is free; and wherein each tooth of said plurality of arcuate first teeth tapers from said proximal end thereof to said distal end thereof.

6. The hair pin as defined in claim 4, wherein said distal end of each tooth of said plurality of arcuate second teeth is free; and wherein each tooth of said plurality of arcuate second teeth tapers from said proximal end thereof to said distal end thereof.

* * * * *